US005158351A

United States Patent [19]

Grundler

[11] Patent Number: 5,158,351

[45] Date of Patent: Oct. 27, 1992

[54] METHOD FOR THE PROTECTION OF AIRCRAFTS AGAINST FLYING OBJECTS COMPRISING UV-HOMING HEADS

[75] Inventor: Johannes Grundler, Piding, Fed. Rep. of Germany

[73] Assignee: Buck Werke GmbH & Company, Bad Uberkingen, Fed. Rep. of Germany

[21] Appl. No.: 841,725

[22] Filed: Feb. 26, 1992

[30] Foreign Application Priority Data

Mar. 8, 1991 [DE] Fed. Rep. of Germany ..... 4107533

[51] Int. Cl.[5] ..... B64D 47/02

[52] U.S. Cl. ..... 362/62; 362/293; 342/53

[58] Field of Search ..... 342/16, 53; 362/62, 362/293

[56] References Cited

U.S. PATENT DOCUMENTS

| | | | |
|---|---|---|---|
| 3,165,749 | 1/1965 | Cushner | 342/53 X |
| 4,282,527 | 8/1981 | Winderman et al. | 342/53 X |
| 4,743,904 | 5/1988 | Morton et al. | 342/14 |
| 4,988,058 | 1/1991 | Dirscherl et al. | 244/3.16 |
| 5,001,348 | 3/1991 | Dirscherl et al. | 250/372 |

FOREIGN PATENT DOCUMENTS

| | | |
|---|---|---|
| 0010568A1 | 6/1979 | European Pat. Off. . |
| 2219776 | 11/1973 | Fed. Rep. of Germany . |
| 3812984 | 7/1991 | Fed. Rep. of Germany . |
| WO89/06338 | 7/1989 | PCT Int'l Appl. . |

*Primary Examiner*—Stephen F. Husar
*Attorney, Agent, or Firm*—Darby & Darby

[57] ABSTRACT

The present application describes a method for the protection of aircrafts against flying objects comprising UV-homing heads, this method being characterized in that the aircrafts are, at least temporarily, provided with an UV-emitting radiation source.

7 Claims, No Drawings

METHOD FOR THE PROTECTION OF AIRCRAFTS AGAINST FLYING OBJECTS COMPRISING UV-HOMING HEADS

The present invention relates to a method for the protection of aircrafts against flying objects comprising UV-homing heads.

When being in mission, aircrafts are threatened by rockets or flying objects comprising homing heads. For homing guidance or target tracking, one is making use of the radiation with respect to which the aircraft can be distinguished from the environment. One is making use first of all of infrared radiation and ultraviolet radiation. The aircraft has a high specific heat and is therefore an infrared radiator with respect to the cold background. However, as the distance is increased, this contrast is reduced on account of the attenuation so that in case of greater distances target tracking by means of infrared radiation is no longer possible. On the other hand, the sky is forming in the ultraviolet range a homogenous background radiation. The aircraft stands out against this radiation as it does not emit UV-rays itself. It is therefore recognized by an UV-sensor as a dark object against a bright background. A homing head which is sensitive both to infrared rays as well as to ultraviolet rays is therefore able to recognize an aircraft and to track it as a target on account of the characteristic IR-radiation and the missing UV-radiation.

In order to protect aircrafts against flying objects, so-called flares are ejected which are to deflect the flying objects. On account of a pyrotechnical reaction, the flares emit IR-rays and also UV-rays owing to the metals contained in the set. Therefore, only for homing heads plotting only IR-rays, the flares form a false target. For so-called dual mode homing heads detecting both IR-radiation as well as UV-radiation there is possible a distinction between the UV-radiating flare and the UV-shielding aircraft. Consequently, for such dual mode homing heads the ejection of flares does not offer a possibility of protection.

It is the object of the present invention to provide a method for the protection of aircrafts against flying objects comprising homing heads and operating within the UV-wave range.

This object is attained by a method for the protection of aircrafts against flying objects comprising UV-homing heads, which method is characterized in that the aircrafts are, at least temporarily, provided with an UV-emitting radiation source.

According to the present invention, the aircraft is provided witn an UV-emitting radiation source so that with respect to UV-radiation it is no longer seen dark against the bright background. If the thus equipped aircraft ejects flares, these flares cannot be distinguished from the aircraft neither as to UV-radiation nor as to IR-radiation. However, with respect to IR-radiation they can be distinguished from the background and are consequently an attractive target for the homing heads. On account of this signature variation, the homing heads can no longer distinguish the flares being the false targets from the aircraft being the real target.

The aircraft may be provided with a source permanently emitting UV-rays so that UV-rays are emitted during the whole mission. Furthermore, it is possible to set the radiation source into operation only in case of danger caused by flying objects comprising homing heads.

Preferably, the aircraft is provided with a permanently emitting UV-source. Sources permanently emitting UV-rays are UV-lamps. Such lamps are known to those skilled in the art. Suitable lamps are e.g. tungsten-band lamps, mercury-vapor lamps and hydrogen lamps. The UV-lamps are preferrably provided with filters so that only UV-rays are emitted whereas other rays which might be a target for the homing head are suppressed. In a preferred embodiment, these UV-lamps are activated already at take-off and remain illuminated during the whole mission so that the aircraft is protected during the whole mission without any additional steps to be taken by the pilot.

In another embodiment, pyrotechnical flares with metal contained in the active substance are used as UV-emitting radiation source. Suitable substances are e.g. the active substances of signal ammunition and IR-flares.

The UV-emitting radiation source is of such kind that UV-radiation is emitted at least into the lower half space of the aircraft. This object is attained e.g. by the installation of UV-lamps at the mounting position of the navigation lights, the radiant intensity of these UV-lamps being such that a sufficiently great sector is covered. The radiant intensity can easily be determined in response to the type of aircraft.

By the method of the present invention, aircrafts may be protected against flying objects comprising UV-homing heads. In order to protect aircrafts also against homing heads detecting IR-rays or UV-rays in combination with IR-rays, the method of the present invention is preferably combined with the ejection of IR-flares deflecting the homing heads.

What is claimed is:

1. A method for the protection of aircrafts against flying objects comprising UV-homing heads, characterized in that the aircrafts are, at least temporarily, provided with an UV-emitting radiation source.

2. The method of claim 1, characterized in that the UV-emitting radiation source is an UV-lamp.

3. The method of claim 2, characterized in that the UV-lamp is a tungsten-band lamp, a mercury-vapor lamp or a hydrogen lamp.

4. The method of claim 2, characterized in that the UV-lamp is provided with filters so that only the rays of desired wave length are reflected.

5. The method of claim 1, characterized in that the UV-emitting radiation source is provided at the mounting position of the navigation lights of the aircraft.

6. The method of claim 1, characterized in that the UV-lamp is provided with filters so that only the rays of desired wave length are reflected.

7. The method of claim 2, characterized in that the UV-emitting radiation source is provided at the mounting position of the navigation lights of the aircraft.

* * * * *